US007050736B2

(12) United States Patent
Hale et al.

(10) Patent No.: US 7,050,736 B2
(45) Date of Patent: May 23, 2006

(54) SYSTEM AND METHOD FOR CHARGING A PHOTOCONDUCTIVE MEMBER TO AN OPERATING VOLTAGE WHILE ISOLATING A CONDUCTIVE SHAFT

(75) Inventors: Jason Paul Hale, Richmond, KY (US); Donn Duane Bryant, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 21 days.

(21) Appl. No.: 10/807,601

(22) Filed: Mar. 24, 2004

(65) Prior Publication Data

US 2005/0214018 A1 Sep. 29, 2005

(51) Int. Cl.
*G03G 15/00* (2006.01)

(52) U.S. Cl. ..... 399/90; 399/116

(58) Field of Classification Search ..... 399/60, 399/116

See application file for complete search history.

(56) References Cited

U.S. PATENT DOCUMENTS 4,167,321 A * 9/1979 Miyashita et al. ..... 399/167
4,607,937 A 8/1986 Minami
4,839,690 A 6/1989 Onoda et al.
5,130,751 A 7/1992 Sato et al.
5,250,994 A * 10/1993 Ito et al. ..... 399/90
5,283,619 A * 2/1994 Nomura et al. ..... 399/90
5,345,294 A 9/1994 Nomura et al.
5,353,099 A 10/1994 Tsunoda
5,416,565 A 5/1995 Noda
5,450,167 A * 9/1995 Okano et al. ..... 399/88
5,581,325 A 12/1996 Tsuda et al.
5,587,584 A 12/1996 Bergen
5,630,196 A 5/1997 Swain
5,634,175 A * 5/1997 Michlin et al. ..... 399/90
5,722,025 A * 2/1998 Morigami et al. ..... 399/330
5,845,173 A 12/1998 Zogg et al.
5,892,303 A * 4/1999 Wayman et al. ..... 307/147
6,029,019 A 2/2000 Kawai
6,067,429 A * 5/2000 Sugaya et al. ..... 399/167
6,246,851 B1 6/2001 Tietze et al.
6,249,659 B1 * 6/2001 Stickler ..... 399/90
6,336,017 B1 1/2002 Miyamoto et al.
6,382,837 B1 5/2002 Olbrich et al.
6,385,413 B1 * 5/2002 Sasaki et al. ..... 399/90
6,594,454 B1 * 7/2003 Oguma et al. ..... 399/90
6,771,915 B1 * 8/2004 Cais et al. ..... 399/90
6,775,498 B1 * 8/2004 Palumbo et al. ..... 399/176
6,785,489 B1 8/2004 Anderson, II

* cited by examiner

*Primary Examiner*—R. Alexander Smith
(74) *Attorney, Agent, or Firm*—Coats and Bennett, PLLC

(57) ABSTRACT

A photoconductive member for an image forming apparatus includes a hollow, conductive cylindrical drum; an insulating end cap disposed axially within the drum at either end thereof, each end cap including an axial bore; a shaft disposed axially through the drum and the bores, the shaft electrically isolated from the drum by the end caps; and an electrical contact assembly operative to bias the drum, but not the shaft, to an operating voltage.

23 Claims, 4 Drawing Sheets

SYSTEM AND METHOD FOR CHARGING A PHOTOCONDUCTIVE MEMBER TO AN OPERATING VOLTAGE WHILE ISOLATING A CONDUCTIVE SHAFT

BACKGROUND

The present invention relates generally to the field of image forming apparatuses and in particular to a photoconductive member biased to an operating voltage and electrically isolated from a mounting shaft.

A variety of elements within an electrophotographic image forming apparatus operate at relatively high operating voltages. These voltages are used, for example, to precharge a photoconductive member to allow a latent image to be optically formed thereon; to transfer electrically and/or magnetically charged toner particles to the photoconductive member to develop the latent image; and to transfer the developed image from the photoconductive member to a media sheet. Where possible, it is preferable to isolate these voltages to specific operational elements, to reduce the risk of short circuit or electrocution. For example, an operating voltage applied to a photoconductive member is preferably restricted to the photoconductive member itself, and isolated from a metallic housing to which the photoconductive member is mounted.

Electrical isolation of various components has traditionally been addressed in the design of removable cartridges in which the components are mounted. For example, a typical prior art electrophotographic image forming apparatus may include one or more removable cartridges, each cartridge containing a reservoir holding a supply of toner, a photoconductive drum for optically forming a latent image and developing the image with the toner, and a developer roller for applying the toner to the photoconductive drum. The image removable cartridge may additionally include various rollers, paddles, augers and blades, as well known in the art. One or more electrical contacts on the cartridge accept an operating voltage, and transfer it to the appropriate component(s).

A recent development in the state of the art of electrophotography is the separation of many components traditionally CaCO-located in a single removable container into separate units. In some cases, the components may be mounted to a moveable subunit such as a door, and removed from their operational position whenever the subunit is opened. This requires the provision of precise positioning means, so that the components are returned to a precise operating position each time the subunit is mated to the main housing. One well-known way to repeatedly, precisely locate a cylindrical component is to provide V-shaped receiving voids in a rigid frame, into which fit metallic bearings supporting a shaft that runs through the axis of the cylindrical component. In the event that the cylindrical component must be biased to a high operating voltage, however, prior-art electrical contacts would simultaneously bias the conductive shaft to the operating voltage. This may present an unacceptable hazard where the conductive shaft mounts via conductive bearings to a conductive machine frame.

SUMMARY

The present invention relates to a photoconductive member for an image forming apparatus. The photoconductive member includes a hollow, conductive cylindrical core; an insulating end cap disposed axially within the core at either end thereof, each end cap including an axial bore; a shaft disposed axially through the core and the bores, the shaft electrically isolated from the core by the end caps; and an electrical contact assembly operative to bias the core, but not the shaft, to an operating voltage.

DETAILED DESCRIPTION

Figure 1:
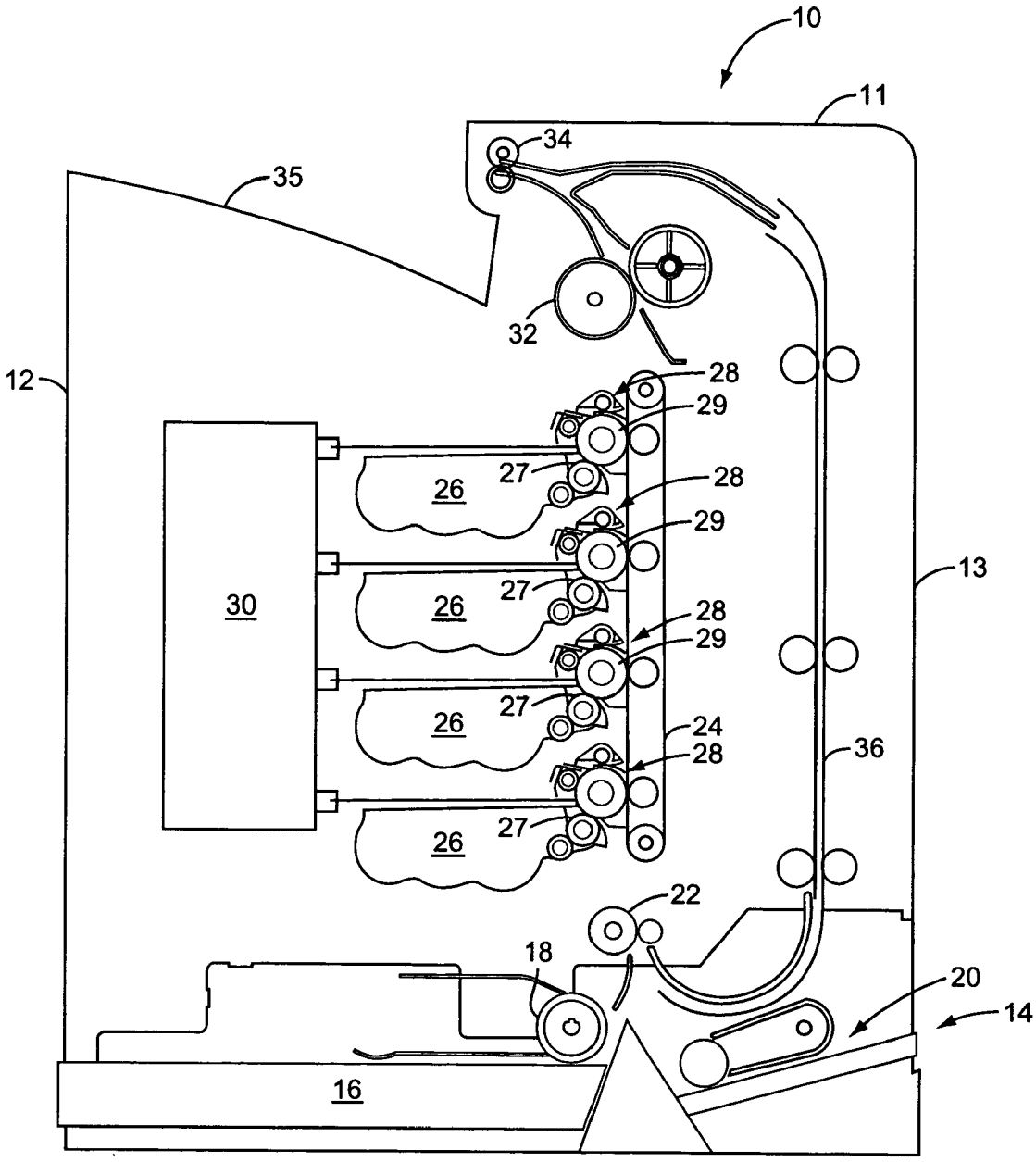
FIG. 1 is a schematic diagram of a representative image forming apparatus having photoconductive members.

FIG. 1 depicts a representative image forming apparatus, indicated generally by the numeral 10. The image forming apparatus 10 comprises a body 12 having a top portion 11, a subunit 13 and a media tray 14. The media tray 14 includes a main media sheet stack 16 with a sheet pick mechanism 18, and a manual input 20. The media tray 14 is preferably removable for refilling, and located on a lower section of the device 10.

Within the image forming apparatus body 12 and/or in the subunit 13, the image forming apparatus 10 includes registration rollers 22, a media sheet transfer belt 24, one or more removable developer units 26, a corresponding number of removable photoconductor units 28, an imaging device 30, a fuser 32, reversible exit rollers 34, and a duplex media sheet path 36, as well as various rollers, actuators, sensors, optics, and electronics (not shown) as are conventionally known in the image forming apparatus arts, and which are not further explicated herein.

The internal components of the developer units 26 and photoconductor units 28 are briefly described (these components are not all explicitly depicted in the drawings). Each developer unit 26 is a removable cartridge that includes a reservoir holding a supply of toner, paddles to agitate and move the toner, a toner adder roll for adding toner to a developer roll 27, a developer roll 27 for applying toner to develop a latent image on a (separate) photoconductive drum, and a doctor blade to regulate the amount of toner on the developer roll 27. Each photoconductor unit 28 is a separate removable cartridge that includes a photoconductive (PC) drum 29. The PC drum 29 may comprise, for example, a hollow aluminum cylindrical drum coated with one or more layers of light-sensitive organic photoconductive materials. The photoconductor unit 28 also includes a charge roll for applying a uniform electrical charge to the surface of the PC drum 29, a photoconductor blade for removing residual toner from the PC drum 29, and an auger to move waste toner out of the photoconductor unit 28 into a waste toner container (not shown).

Each developer unit 26 mates with a corresponding photoconductor unit 28, with the developer roll 27 of the developer unit 26 developing a latent image on the surface of the PC drum 29 of the photoconductor unit 28 by supplying toner to the PC drum 29. In a typical color printer, three or four colors of toner—cyan, yellow, magenta, and optionally black—are applied successively (and not necessarily in that order) to a print media sheet to create a color image. Correspondingly, FIG. 1 depicts four pairs of developer units 26 and photoconductor units 28.

The operation of the image forming apparatus 10 is conventionally known. Upon command from control electronics, a single media sheet is "picked," or selected, from either the primary media stack 16 or the manual input 20. Alternatively, a media sheet may travel through the duplex path 36 for a two-sided print operation. Regardless of its source, the media sheet is presented at the nip of a registration roller 22, which aligns the sheet and precisely controls its further movement into the print path.

The media sheet passes the registration roller 22 and contacts the transport belt 24, which carries the media sheet successively past the photoconductor units 28. At each photoconductor unit 28, a latent image is formed by the imaging device 30 and optically projected onto the PC drum 29. The latent image is developed by applying toner to the PC drum 29 from the developer roll 27 of the corresponding developer unit 26. The toner is subsequently deposited on the media sheet as it is conveyed past the photoconductor unit 28 by the transport belt 24.

The toner is thermally fused to the media sheet by the fuser 32, and the sheet then passes through reversible exit rollers 34, to land facedown in the output stack 35 formed on the exterior of the image forming apparatus body 12. Alternatively, the exit rollers 34 may reverse motion after the trailing edge of the media sheet has passed the entrance to the duplex path 36, directing the media sheet through the duplex path 36 for the printing of another image on the back side thereof.

Figure 2:
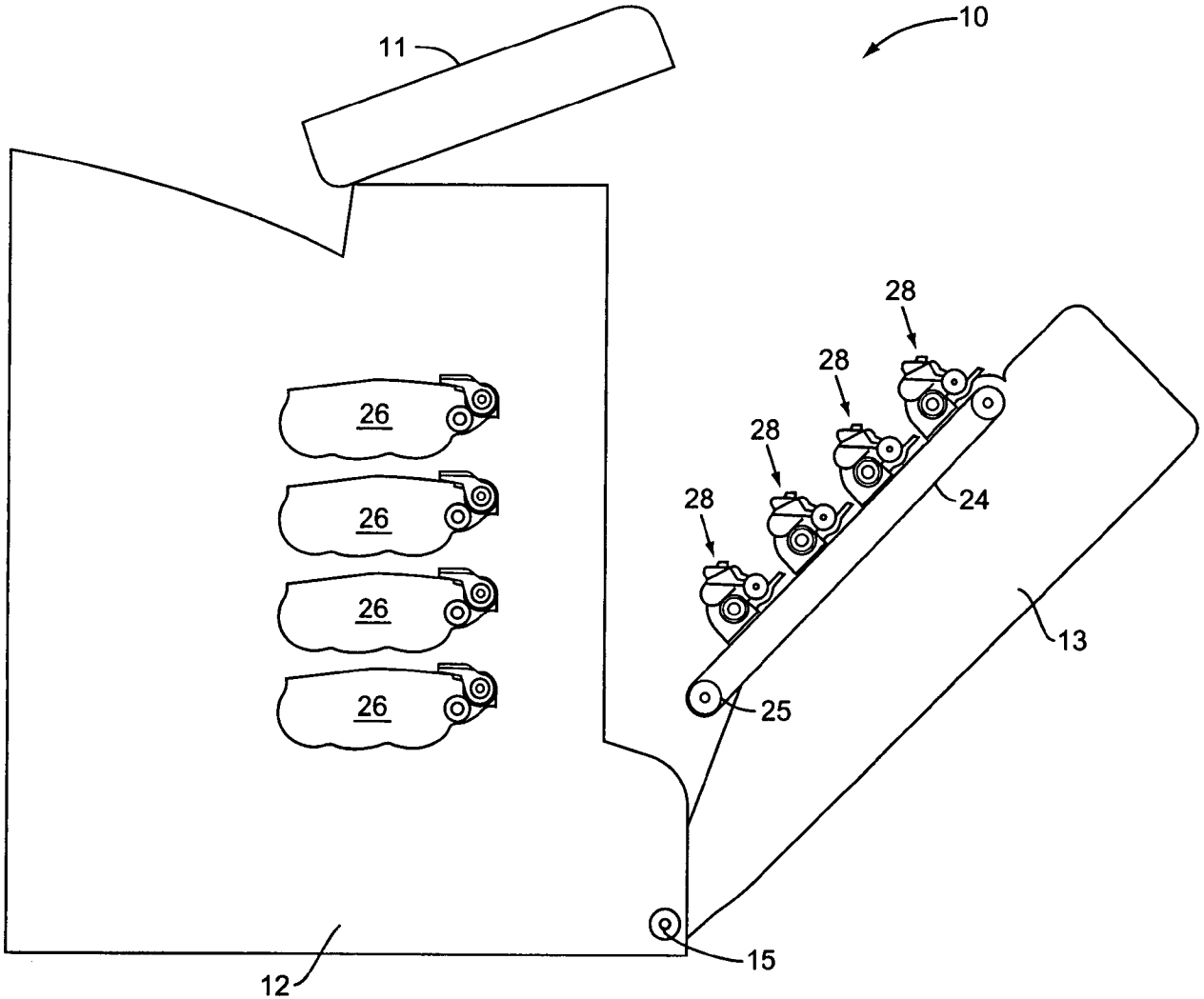
FIG. 2 is a schematic diagram of a representative image forming apparatus having subunit movable between open and closed positions.

FIG. 2 depicts an image forming apparatus 10 wherein a top cover 11 is opened, and a subunit 13 is separated from the main housing 12 by pivoting about a hinge point 15. At least the media sheet transport belt 24 and the photoconductor units 28 are mounted to the subunit 13. In this manner, a user may access both the developer units 26 and photoconductor units 28, such as for removal and replacement.

Accurate positioning of the PC drums 29 is critical to high quality printing. To ensure accurate positioning of the PC drums 29, V-blocks 40 are cut into the metal framework 42 of the housing 12 of the image-forming apparatus 10. A steel shaft 44 running through each PC drum 29 is precisely located within a corresponding V-block 40 by a ball bearing assembly 46. Alternatively, other metallic bearings 46 may be used.

During operation, the PC drum 29 is charged to an operating voltage, such as −200V. However, because the steel shaft 44 is electrically connected to the metal frame 42 via ball bearings 46, the −200V supplied to the PC drum 29 must be electrically isolated from the steel shaft 44, for user safety considerations.

Figure 3:
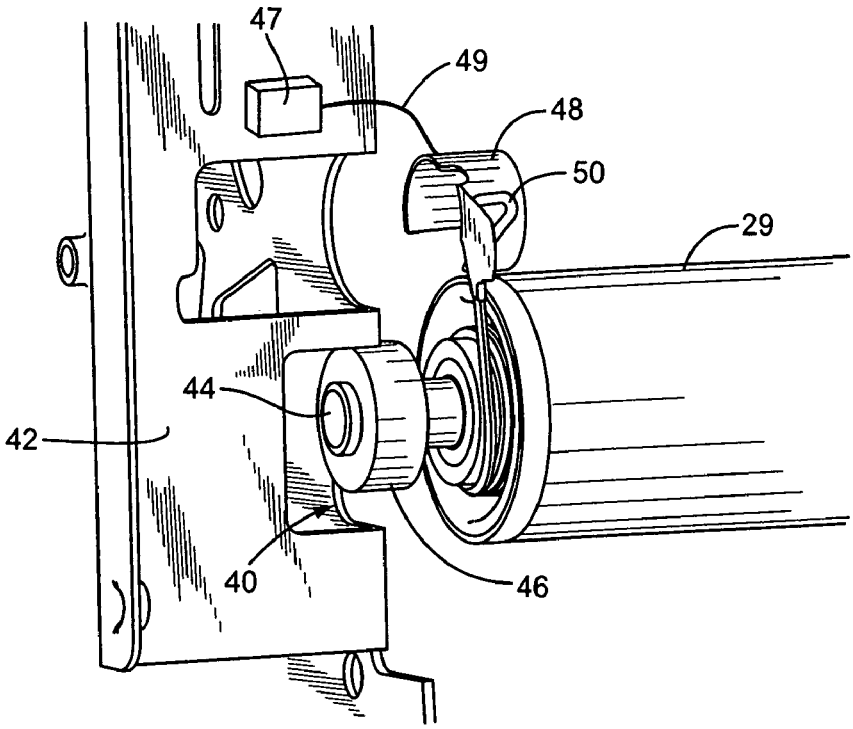
FIG. 3 is a partial perspective view of one end of a photoconductive member mounting to a frame.

According to the present invention, an electrical connection is established between a biasing contact 48 disposed on part of the photoconductor unit 28 (not depicted in FIG. 3) and the photoconductive drum 29. The biasing contact 48 is biased to an operating voltage by an appropriate power supply 47 and electrical conductor 49. The actual configuration of the power supply 47 and its electrical connection to the biasing contact 48 is not material to the present discussion. An external electrical connector 50 forms electrical contact with the biasing contact 48, and transfers the charge to the PC drum 29, as described below with reference to FIGS. 4 and 5.

The external electrical connector 50 is an integral part of the PC drum brake 52. The brake 52 counters rotational forces imparted to the PC drum 29 by the corresponding developer roller 27 contacting it, which rotates at a slightly higher speed than the PC drum 29. This tends to accelerate the rotational speed of the PC drum 29, a tendency that the PC drum brake 52 counters, such that the PC drum 29 actually rotates at a speed determined by its own drive mechanism.

The PC drum brake 52 is disposed about an annular conductive hub 54. The annular conductive hub 54 is electrically conductive, and is preferably formed from a conductive plastic. Alternatively, the annular conductive hub 54 may be formed from any suitable material, as well known in the art. The annular conductive hub 54 includes at least one protrusion 56, directed toward the interior of the PC drum 29.

Figure 4:
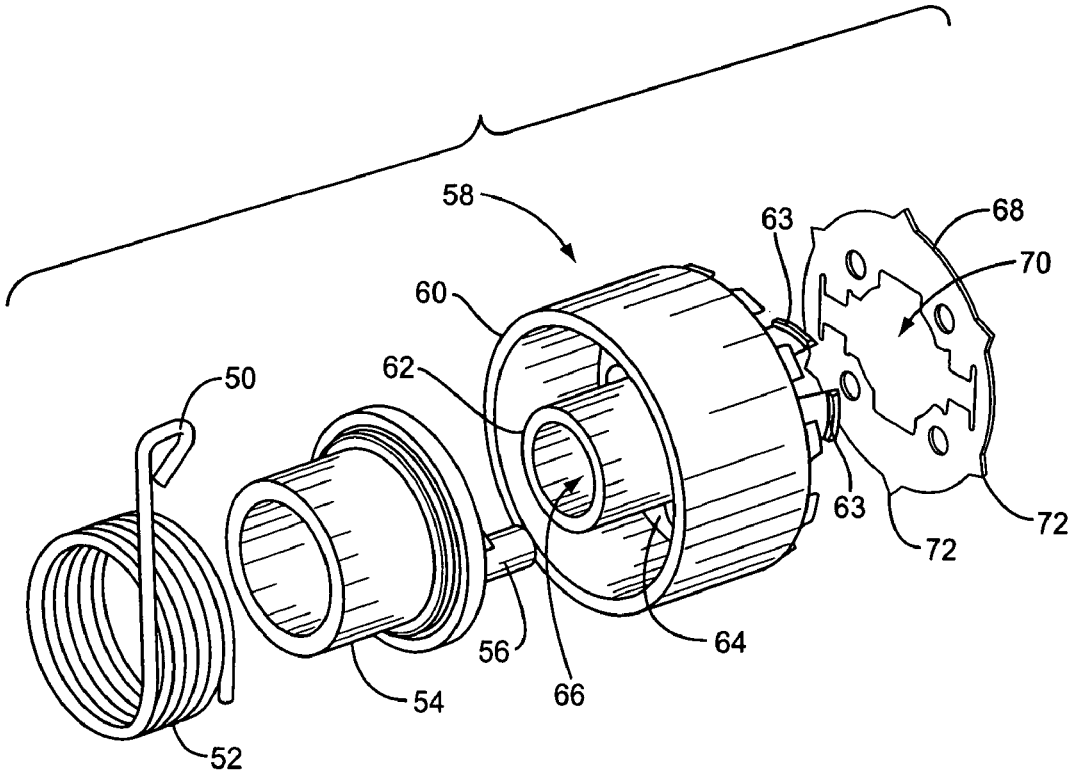
FIG. 4 is an exploded perspective view of the end cap subunit of a photoconductive member.

The PC drum brake 52 is disposed over the annular conductive hub 54, and the assembly of the two is disposed within an insulating end cap 58. The insulating end cap 58 is an electrical insulator, and may be formed of any suitable material, such as rubber, plastic, and the like, as known in the art. The insulating end cap 58 comprises an outer annular ring 60, an inner annular ring 62 and a floor 64 forming a cylindrical chamber, in which the assembly comprising PC drum brake 52 and annular conductive hub 54 is disposed. The inner annular wall 62 defines a bore 66, through which the steel shaft 44 is disposed. Disposed opposite the floor 64 from the inner annular wall 62, and protruding into the interior region of the PC drum 29, is an interior annular wall 63, which may be segmented, as shown in FIG. 4. The interior annular wall 63 shares the through bore 66 with the inner annular wall 62.

At least one protrusion 56 of the annular conductive hub 54 protrudes through the floor 64 of the insulating end cap 58, and forms an electrical connection to a generally disc-shaped internal electrical contact 68. The internal electrical contact 68 is electrically conductive, and contains a large bore 70 formed in the central region thereof. When assembled, the interior annular wall 63 of the insulating end cap 58 may protrude through the bore 70 in the internal electrical contact 68. The interior annular wall 63 assists in the capture of the steel shaft 44 as it passes through the PC drum 29, and may additionally electrically isolate the shaft 44 from the internal electrical contact 68. Disposed around the periphery of the internal electrical contact 68 is a plurality of points or protrusions 72. The points 72 extend slightly outward of the inner diameter of the PC drum 29, and thus form physical and electrical contact to the interior surface of the PC drum 29 when the internal electrical contact 68 is disposed within the PC drum 29.

Figure 5:
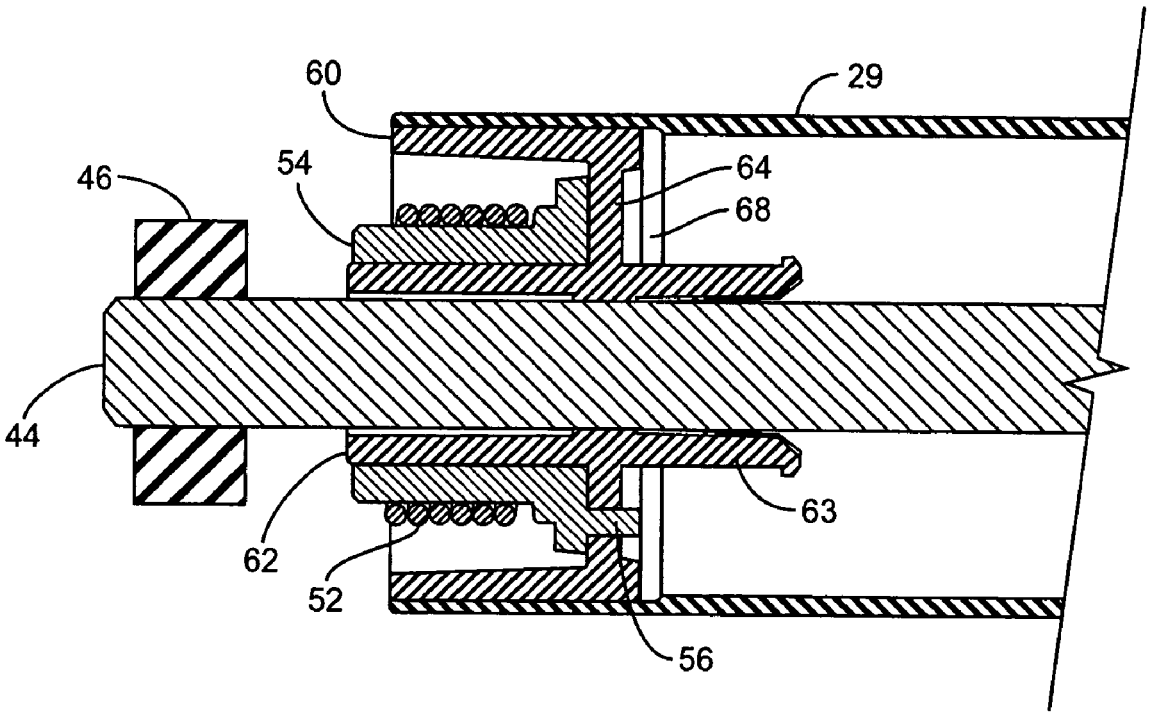
FIG. 5 is a partial section view of one end of a photoconductive member.

The entire end cap 58 and electrical connector assembly according to the present invention is preferably assembled and then press fitted into at least one end of the PC drum 29, as depicted in section view in FIG. 5. Note that the outer annular wall 60 of the insulating end cap 58 need not be flush with the PC drum 29 as shown; rather, it may include a shoulder and extend at least partially externally to the PC drum 29. In operation, the external electrical contact 50 (contacting a biasing contact 48) biases the PC drum brake 52 to an operating voltage. The PC drum brake 52, in physical and electrical contact with annular conductive hub 54, biases the annular conductive hub 54 to the operating voltage. Both the PC drum brake 52 and annular conductive hub 54 are electrically isolated from the steel shaft 44 by the inner annular ring 62 of the insulating end cap 58. Both elements are additionally electrically isolated from the PC drum 29 by the outer annular ring 60 of the insulating end cap 58. At least one protrusion 56 extends from the annular conductive hub 54 through the floor 64 of the insulating end cap 58, making physical and electrical contact to the internal electrical contact 68. The internal electrical contact 68 is electrically isolated from the steel shaft 44 by the internal annular ring 63 of the insulating end cap 58. The points 72 disposed around the periphery of the internal electrical contact 68 are press fitted into physical and electrical contact with the interior surface of the PC drum 29, biasing the PC drum 29 to its operating voltage.

In this manner, the PC drum 29 is biased to an operating voltage, such as for example, −200V, while the steel shaft 44, located in a V-block 40 of the metal frame 42 via ball bearings 46, is insulated from the operating voltage. This prevents the metal frame 42 from becoming an electrocution hazard to the user.

Although the present invention has been described herein with respect to particular features, aspects and embodiments thereof, it will be apparent that numerous variations, modifications, and other embodiments are possible within the broad scope of the present invention, and accordingly, all variations, modifications and embodiments are to be regarded as being within the scope of the invention. The present embodiments are therefore to be construed in all aspects as illustrative and not restrictive and all changes coming within the meaning and equivalency range of the appended claims are intended to be embraced therein.

What is claimed is:

1. An image forming apparatus, comprising:

a housing, including a metallic frame;

a photoconductive member including a shaft removably mounted to said metallic frame; and an electrical connector assembly associated with said photoconductive member, the electrical connector assembly comprising a nonconductive wall disposed between an electrical contact and said shaft, the electrical contact being operative to bias said photoconductive member to an operating voltage without biasing said shaft to said operating voltage.

2. The apparatus of claim 1, said shaft including a bearing, wherein said bearing mounts to said frame.

3. The apparatus of claim 2 wherein said bearing mounts to a V-shaped receptacle in said frame.

4. The apparatus of claim 1 further comprising a subunit detachable from said housing, and wherein said photoconductive member is mounted to said subunit.

5. A photoconductive member for an image forming apparatus, comprising:

a hollow, conductive cylindrical drum;

an insulating end cap disposed axially at least partially within said drum, said end cap including a bore that is at least partly defined by a cylindrical inner wall;

a shaft disposed axially through said drum and said bore and spaced from said drum, said shaft electrically isolated from said drum by said end cap; and an electrical contact assembly operative to bias said drum, but not said shaft, to an operating voltage, said cylindrical inner wall being disposed between said electrical contact assembly and said shaft.

6. The photoconductive member of claim 5 wherein said electrical contact assembly electrically contacts said drum at the interior surface thereof.

7. The photoconductive member of claim 5 wherein said electrical contact assembly protrudes at least partially through said end cap to the interior of said drum.

8. The photoconductive member of claim 5 wherein said electrical contact assembly protrudes at least partially external to said end cap to an electrical contact disposed in said image forming apparatus.

9. A photoconductive member for an image forming apparatus, comprising:

a hollow, conductive cylindrical drum;

an insulating end cap disposed axially at least partially within said drum, said end cap including a bore and further comprising a cup having an outer cylindrical wall, a floor, and an inner cylindrical wall defining said bore, said outer and inner walls and said floor defining an annular space;

a shaft disposed axially through said drum and said bore and spaced from said drum, said shaft electrically isolated from said drum by said end cap; and an electrical contact assembly operative to bias said drum, but not said shaft, to an operating voltage, said electrical contact assembly comprising an annular conductive hub disposed in said end cap annular space.

10. The photoconductive member of claim 9 wherein said annular conductive hub is formed of conductive plastic.

11. The photoconductive member of claim 9 wherein said conductive hub includes at least one protrusion disposed through a hole in said end cap floor and into the interior of said drum.

12. The photoconductive member of claim 11 wherein said electrical contact assembly further comprises an internal contact electrically connected between said conductive hub protrusion and the interior surface of said drum.

13. The photoconductive member of claim 9 wherein said electrical contact assembly further comprises an external electrical contact electrically connected to said conductive hub and protruding at least partially from said end cap.

14. A photoconductive member for an image forming apparatus, comprising:

a hollow cylindrical member having an exterior surface operative to receive a latent image; and an electrically conductive brake member operative to reduce the rotational velocity of said cylindrical member, said brake member additionally biasing said cylindrical member to an operating voltage; and an insulating end cap disposed axially within said hollow cylindrical member, said end cap including an inner wall, said brake member comprising a coil disposed around the inner wall and operative to impart a torque on said cylindrical member.

15. The photoconductive member of claim 14 wherein said electrically conductive brake member includes an arm protruding from said photoconductive member and contacting an electrical contact separate from said photoconductive member.

16. The photoconductive member of claim 14 wherein said electrically conductive brake member biases said cylindrical member by electrical contact on the interior surface thereof.

17. The photoconductive member of claim 14 further comprising a shaft disposed axially through, and electrically isolated from, both said cylindrical member and said brake member.

18. A photoconductive member for an image forming apparatus, comprising:

a hollow cylindrical member having an exterior surface operative to receive a latent image;

a shaft disposed axially through, and electrically isolated from, said cylindrical member; and an electrical contact operative to bias said cylindrical member to an operating voltage by contact with the interior surface of said cylindrical member, wherein said electrical contact does not bias said shaft to said operating voltage as said electrical contact is electrically isolated from said shaft by an insulating end cap that is disposed between said electrical contact and said shaft.

19. The photoconductive member of claim 18 wherein said electrical contact is disposed in one end of said cylindrical member.

20. The photoconductive member of claim 18 wherein said insulating end cap includes a bore through which said shaft is disposed, said bore operative to axially position said shaft in said cylindrical member and electrically isolate said shaft from said cylindrical member.

21. The photoconductive member of claim 18 wherein said electrical contact protrudes through said end cap to contact the interior of said cylindrical member.

22. A method of electrically biasing a photoconductive member for an image forming apparatus having a metallic frame, to an operating voltage, said photoconductive member including a hollow, cylindrical member and a shaft having bearings thereon axially disposed in said cylindrical member, comprising:

mounting said photoconductive member in said image forming apparatus such that said shaft bearings connect to receiving voids formed in said metallic frame, electrically isolating said shaft from said cylindrical member; and biasing said cylindrical member to said operating voltage by electrically connecting an electrical contact to the interior surface of said hollow cylindrical member while interposing an insulating wall at least partly between said electrical contact and said shaft.

23. The method of claim 22 further comprising electrically connecting a conductive hub to the electrical contact and to the interior surface of said hollow cylindrical member while interposing said insulating wall at least partly between said conductive hub and said shaft.

* * * * *